US011700474B2

(12) United States Patent
Wilson et al.

(10) Patent No.: US 11,700,474 B2
(45) Date of Patent: Jul. 11, 2023

(54) MULTI-MICROPHONE HEADSET

(71) Applicant: New Audio LLC, New York, NY (US)

(72) Inventors: Thomas C. Wilson, Brooklyn, NY (US); Clayton J. Pipkin, Highland Park, NJ (US); Marten Wallby, Malmo (SE); Zachary Hellman, New York, NY (US); Jonathan Levine, New York, NY (US)

(73) Assignee: New Audio LLC, New York, NY (US)

( * ) Notice: Subject to any disclaimer, the term of this patent is extended or adjusted under 35 U.S.C. 154(b) by 0 days.

(21) Appl. No.: 17/357,761

(22) Filed: Jun. 24, 2021

(65) Prior Publication Data

US 2022/0417639 A1 Dec. 29, 2022

(51) Int. Cl.
*H04R 1/10* (2006.01)

(52) U.S. Cl.
CPC ..... *H04R 1/1041* (2013.01); *H04R 2420/05* (2013.01); *H04R 2420/07* (2013.01)

(58) Field of Classification Search
CPC ..... H04R 1/1041
See application file for complete search history.

(56) References Cited

U.S. PATENT DOCUMENTS

| | | | |
|---|---|---|---|
| 1,127,161 | A | 2/1915 | Baldwin |
| 1,289,826 | A | 12/1918 | Lawton |
| 1,367,746 | A | 2/1921 | Kent |
| 1,483,315 | A | 2/1924 | Saal |
| 1,489,978 | A | 4/1924 | Oscar |
| 1,555,997 | A | 10/1925 | Tiodolf |
| 1,587,409 | A | 6/1926 | Ouillette |
| 1,648,832 | A | 11/1927 | Ladislaus |
| 1,649,551 | A | 11/1927 | Smith |
| 1,651,623 | A | 12/1927 | Obergfell |
| 1,714,377 | A | 5/1929 | George |
| 1,821,529 | A | 9/1931 | Samuel |
| 1,926,688 | A | 9/1933 | Schaal |
| 2,010,612 | A | 8/1935 | Stafford |
| 2,140,132 | A | 12/1938 | Hollett |

(Continued)

FOREIGN PATENT DOCUMENTS

| | | |
|---|---|---|
| CN | 304974345 | 1/2019 |
| CN | 306794554 | 8/2021 |

(Continued)

OTHER PUBLICATIONS

"Restriction Requirement Issued in U.S. Appl. No. 29/796,516", dated Jan. 24, 2023, 11 Pages.

(Continued)

*Primary Examiner* — Simon King
(74) *Attorney, Agent, or Firm* — Holzer Patel Drennan

(57) ABSTRACT

An audio device includes one or more earcups, at least one of the earcups including a boom connector port, a connection detector connected to the boom connector port and configured to detect a connection state at the boom connector port, one or more first microphones positioned in the one or more earcups, audio processing circuitry, and a microphone switch controller connected to the connection detector and configured to connect audio processing circuitry to one of the one or more first microphones or the boom connector port based on the detected connection state of the boom connector port.

23 Claims, 10 Drawing Sheets

(56) References Cited

U.S. PATENT DOCUMENTS

| | | | |
|---|---|---|---|
| 2,235,372 | A | 3/1941 | Otto |
| 2,373,172 | A | 4/1945 | Sinkler |
| 2,394,374 | A | 2/1946 | Gilman |
| 2,413,345 | A | 12/1946 | Gilman |
| 2,486,267 | A | 10/1949 | Dulinsky |
| 2,497,007 | A | 2/1950 | Constantine |
| 2,503,432 | A | 4/1950 | Bowers |
| 2,510,344 | A | 6/1950 | Law |
| 2,511,234 | A | 6/1950 | Anderson |
| 2,652,457 | A | 9/1953 | Knowles |
| 2,670,807 | A | 3/1954 | Brown |
| 2,747,191 | A | 5/1956 | Hoffmaster |
| 2,782,423 | A | 2/1957 | Eli et al. |
| 2,858,544 | A | 11/1958 | Roth |
| 2,924,290 | A | 2/1960 | Zuerker |
| 2,946,860 | A | 7/1960 | Jansen et al. |
| 3,053,944 | A | 9/1962 | Weeks |
| 3,073,410 | A | 1/1963 | Gongoll et al. |
| 3,119,904 | A | 1/1964 | Anson |
| 3,183,565 | A | 5/1965 | Schwarz |
| 3,272,926 | A | 9/1966 | Falkenberg |
| 3,440,663 | A | 4/1969 | Beguin |
| 3,445,597 | A | 5/1969 | Walters |
| 3,454,964 | A | 7/1969 | Brinkhoff |
| 3,488,457 | A | 1/1970 | Lahti |
| 3,505,684 | A | 4/1970 | Hutchinson et al. |
| 3,562,816 | A | 2/1971 | Hutchinson |
| 3,579,640 | A | 5/1971 | Beguin et al. |
| 3,593,341 | A | 7/1971 | Aileo |
| 3,797,045 | A | 3/1974 | Aho |
| 3,815,155 | A | 6/1974 | Davison et al. |
| 3,859,748 | A | 1/1975 | Blue |
| 3,908,200 | A | 9/1975 | Lundin |
| 3,922,725 | A | 12/1975 | Csiki et al. |
| 3,959,989 | A | 6/1976 | Bhandia |
| 3,984,885 | A | 10/1976 | Yoshimura et al. |
| D244,037 | S | 4/1977 | Warner et al. |
| D244,301 | S | 5/1977 | Besasie |
| 4,037,064 | A | 7/1977 | Kasuda |
| D250,761 | S | 1/1979 | Vong |
| 4,173,715 | A | 11/1979 | Gosman |
| 4,175,217 | A | 11/1979 | Williams |
| D254,183 | S | 2/1980 | Doodson |
| D255,352 | S | 6/1980 | Besasie |
| 4,274,181 | A | 6/1981 | Schaller |
| 4,306,121 | A | 12/1981 | Joscelyn et al. |
| 4,309,575 | A | 1/1982 | Zweig et al. |
| 4,385,209 | A | 5/1983 | Greason et al. |
| 4,424,881 | A | 1/1984 | Hattori |
| 4,437,538 | A | 3/1984 | Ohlsson et al. |
| 4,439,645 | A | 3/1984 | Scalzo |
| D274,516 | S | 7/1984 | Walker |
| 4,472,607 | A | 9/1984 | Houng |
| 4,538,034 | A | 8/1985 | French |
| D287,849 | S | 1/1987 | Preisler et al. |
| D291,198 | S | 8/1987 | Bellini |
| 4,689,822 | A | 8/1987 | Houng |
| 4,727,585 | A | 2/1988 | Flygstad |
| 4,747,145 | A | 5/1988 | Wiegel |
| 4,796,307 | A | 1/1989 | Vantine |
| 4,829,571 | A | 5/1989 | Kakiuchi et al. |
| D315,561 | S | 3/1991 | Miller |
| D317,767 | S | 6/1991 | Banks |
| 5,035,005 | A | 7/1991 | Hung |
| D328,074 | S | 7/1992 | Yamazaki et al. |
| D337,116 | S | 7/1993 | Hattori |
| 5,233,650 | A | 8/1993 | Chan |
| D345,163 | S | 3/1994 | Yamatogi |
| 5,293,647 | A | 3/1994 | Mirmilshteyn et al. |
| 5,333,206 | A | 7/1994 | Koss |
| D358,391 | S | 5/1995 | Isono |
| 5,438,626 | A | 8/1995 | Neuman et al. |
| 5,457,751 | A | 10/1995 | Such |
| D364,617 | S | 11/1995 | Fitzgerald |
| 5,499,985 | A | 3/1996 | Hein et al. |
| 5,551,090 | A | 9/1996 | Thompson |
| D386,181 | S | 11/1997 | Fisher |
| 5,697,386 | A | 12/1997 | Chang |
| D390,282 | S | 2/1998 | Burdick |
| 5,729,615 | A | 3/1998 | Yang |
| 5,822,798 | A | 10/1998 | Baxley |
| D402,318 | S | 12/1998 | Dunipace |
| D402,659 | S | 12/1998 | Suzuki |
| 5,862,241 | A | 1/1999 | Nelson |
| D410,466 | S | 6/1999 | Mouri |
| D413,550 | S | 9/1999 | Otterson et al. |
| D415,763 | S | 10/1999 | Petchonka |
| D420,356 | S | 2/2000 | Suzuki |
| D422,206 | S | 4/2000 | Clark |
| D423,012 | S | 4/2000 | Yasutomi |
| D424,150 | S | 5/2000 | Post |
| D425,888 | S | 5/2000 | Fitzgerald |
| 6,081,604 | A | 6/2000 | Hikichi et al. |
| D431,550 | S | 10/2000 | Yoneda |
| D432,522 | S | 10/2000 | Kieltyka et al. |
| D435,249 | S | 12/2000 | Yasutomi |
| 6,201,877 | B1 | 3/2001 | Chang |
| D441,734 | S | 5/2001 | Fitzgerald |
| 6,263,085 | B1 | 7/2001 | Weffer |
| D453,015 | S | 1/2002 | Yuyama |
| D456,379 | S | 4/2002 | Fitzgerald |
| 6,392,196 | B1 | 5/2002 | Lin |
| 6,427,018 | B1 | 7/2002 | Keliiliki |
| D464,630 | S | 10/2002 | Woodworth |
| 6,611,963 | B2 | 9/2003 | Woo et al. |
| D484,485 | S | 12/2003 | Matsuoka |
| 6,654,966 | B2 | 12/2003 | Rolla |
| D491,917 | S | 6/2004 | Asai |
| D504,414 | S | 4/2005 | Yoshida |
| D508,483 | S | 8/2005 | Suzuki |
| D512,708 | S | 12/2005 | Harris et al. |
| 6,980,165 | B2 | 12/2005 | Yuasa et al. |
| D514,087 | S | 1/2006 | Wilson et al. |
| D517,527 | S | 3/2006 | Suzuki |
| D518,474 | S | 4/2006 | Suzuki |
| 7,106,873 | B1 | 9/2006 | Harrison et al. |
| 7,146,004 | B2 | 12/2006 | Bodley et al. |
| 7,172,052 | B2 | 2/2007 | Lenhard-Backhaus |
| D538,261 | S | 3/2007 | Taylor et al. |
| 7,251,335 | B1 | 7/2007 | Chen |
| D560,654 | S | 1/2008 | Feng |
| D567,215 | S | 4/2008 | Lee |
| 7,388,960 | B2 | 6/2008 | Kuo et al. |
| 7,391,878 | B2 | 6/2008 | Liao |
| D573,581 | S | 7/2008 | Gondo et al. |
| D576,604 | S | 9/2008 | Suzuki |
| 7,457,649 | B1 | 11/2008 | Wilson |
| D588,098 | S | 3/2009 | Kurihara |
| D592,640 | S | 5/2009 | Tkachuk |
| D600,673 | S | 9/2009 | Kim et al. |
| D600,674 | S | 9/2009 | Brennwald |
| 7,639,478 | B2 | 12/2009 | Wu et al. |
| D613,266 | S | 4/2010 | Barry et al. |
| D617,781 | S | 6/2010 | Kallas et al. |
| D620,474 | S | 7/2010 | Komiyama |
| D633,367 | S | 3/2011 | Scherr |
| D633,895 | S | 3/2011 | Morimoto |
| D634,732 | S | 3/2011 | Kondo et al. |
| D635,958 | S | 4/2011 | Ando et al. |
| D637,176 | S | 5/2011 | Brunner et al. |
| D639,776 | S | 6/2011 | Arimoto |
| D641,725 | S | 7/2011 | Chong et al. |
| D642,554 | S | 8/2011 | Schaal et al. |
| D646,666 | S | 10/2011 | Maeyama |
| D652,021 | S | 1/2012 | Miyawaki |
| D652,022 | S | 1/2012 | Miyawaki |
| D652,406 | S | 1/2012 | Lee et al. |
| 8,094,859 | B2 | 1/2012 | Suematsu et al. |
| 8,098,872 | B2 | 1/2012 | Chang |
| D657,344 | S | 4/2012 | Brunner et al. |
| D657,776 | S | 4/2012 | Lee et al. |
| D660,823 | S | 5/2012 | Hardi et al. |
| D660,824 | S | 5/2012 | Hardi et al. |
| D662,080 | S | 6/2012 | Carr et al. |

(56) References Cited

U.S. PATENT DOCUMENTS

D662,490 S 6/2012 Mcsweyn
D663,716 S 7/2012 Hardi et al.
D664,116 S 7/2012 Hutchieson
D664,118 S 7/2012 Tappeiner et al.
8,213,644 B2 7/2012 Choi
D665,775 S 8/2012 Katsumata
D666,579 S 9/2012 Hou
D666,992 S 9/2012 Lee et al.
D671,914 S 12/2012 Lee et al.
D672,745 S 12/2012 Abed et al.
8,325,962 B2 12/2012 Ishida et al.
D673,519 S 1/2013 Tan
D673,520 S 1/2013 Tan
D677,243 S 3/2013 Kitayama et al.
D677,647 S 3/2013 Lee et al.
D680,999 S 4/2013 Chan
D683,329 S 5/2013 Hagelin
8,437,481 B2 5/2013 Johnson
8,447,370 B2 5/2013 Ueda et al.
D684,559 S 6/2013 Groset et al.
D686,758 S 7/2013 Metcalf
D689,843 S 9/2013 Lee
D691,579 S 10/2013 Lee et al.
D693,791 S 11/2013 Troy
D695,263 S 12/2013 Mogili
D696,644 S 12/2013 Sejpka
D697,495 S 1/2014 Lian
D705,750 S 5/2014 Wu et al.
8,737,668 B1 5/2014 Blair et al.
D706,241 S 6/2014 Szymanski et al.
8,755,555 B2 6/2014 Dougherty et al.
D708,162 S 7/2014 Wenger et al.
8,774,442 B2 7/2014 Huang
D712,872 S 9/2014 Yuen
D716,762 S 11/2014 Greve
D721,052 S 1/2015 Carr et al.
D722,998 S 2/2015 Sancho et al.
D723,511 S 3/2015 Pedersen
D727,280 S 4/2015 Levine
D727,281 S 4/2015 Levine
D727,289 S 4/2015 Czaniecki
D728,512 S 5/2015 Nakagawa
D729,194 S 5/2015 Boeckel et al.
D732,503 S 6/2015 Brunner et al.
D733,090 S 6/2015 Petersen
D733,092 S 6/2015 Gan
D734,296 S 7/2015 Paterson et al.
D736,174 S 8/2015 Levine
D736,175 S 8/2015 Levine
D736,185 S 8/2015 Yaegashi et al.
9,106,986 B2 8/2015 Shen et al.
D737,799 S 9/2015 Carr et al.
D741,842 S 10/2015 Levine
D745,214 S 12/2015 Haas
D746,790 S 1/2016 Strasberg et al.
9,234,654 B1 1/2016 Wang
D759,626 S 6/2016 Wagner
D762,190 S 7/2016 Levine
D762,191 S 7/2016 Levine
D765,055 S 8/2016 Hsieh et al.
D768,110 S 10/2016 Suzuki
D771,012 S 11/2016 Wagner
D772,841 S 11/2016 Levine
D780,155 S 2/2017 Levine et al.
D781,265 S 3/2017 Levine et al.
D781,814 S 3/2017 Levine
D782,995 S 4/2017 Matthews
D789,327 S 6/2017 Miyake et al.
D792,376 S 7/2017 Morimoto et al.
D795,218 S 8/2017 Ohmachi
9,729,954 B2 8/2017 Levine et al.
D805,056 S 12/2017 Levine
D808,359 S 1/2018 Meyer et al.
D809,477 S 2/2018 Brunner et al.
D809,478 S 2/2018 Arimoto et al.
D810,055 S 2/2018 Levine
D811,362 S 2/2018 Petersen
D811,365 S 2/2018 Czaniecki
D812,588 S 3/2018 Levine
D813,194 S 3/2018 Loh et al.
9,917,940 B2 3/2018 Broadley et al.
D815,614 S 4/2018 Tzeng et al.
9,972,895 B2 5/2018 Hirsch et al.
D820,810 S 6/2018 Levine et al.
D826,208 S 8/2018 Czaniecki
D832,811 S 11/2018 Levine et al.
D832,813 S 11/2018 Levine et al.
D833,071 S 11/2018 Pennington
D836,600 S 12/2018 Lee et al.
D845,928 S 4/2019 Lee et al.
D849,713 S 5/2019 Hänggi et al.
D851,627 S 6/2019 Ter Laag et al.
D852,166 S 6/2019 Levine
10,327,057 B2 6/2019 Levine et al.
D857,652 S 8/2019 Wang
D857,654 S 8/2019 Levine
D859,354 S 9/2019 Xia
D864,898 S 10/2019 Chen
D865,706 S 11/2019 Li et al.
D868,029 S 11/2019 Hänggi et al.
D868,731 S 12/2019 Jung
D878,329 S 3/2020 Levine et al.
D879,067 S 3/2020 Hu
D879,742 S 3/2020 Hu
D882,544 S 4/2020 Paterson et al.
10,659,874 B2 5/2020 Johnson et al.
D888,010 S 6/2020 Lindenberger
10,674,245 B2 6/2020 Chih-Hsueh et al.
D890,123 S 7/2020 Yoshimura
D893,453 S 8/2020 Levine et al.
10,743,106 B2 8/2020 Daley et al.
10,757,499 B1 8/2020 Vautrin et al.
D897,309 S 9/2020 Cho et al.
D920,956 S 6/2021 Levine
D936,035 S 11/2021 Tang et al.
D937,242 S 11/2021 Levine
D946,551 S 3/2022 Liu
D961,548 S 8/2022 Yang
D966,228 S 10/2022 Cho
D968,357 S 11/2022 Cong
D974,327 S 1/2023 Shyu et al.
2003/0210801 A1 11/2003 Naksen et al.
2004/0216946 A1 11/2004 Lenhard-Backhaus
2004/0229658 A1* 11/2004 Kim ..... H04M 1/6066 455/569.1
2005/0008184 A1* 1/2005 Ito ..... H04M 1/05 381/370
2005/0053255 A1 3/2005 Harris et al.
2005/0105755 A1 5/2005 Yueh
2005/0238189 A1 10/2005 Tsai
2005/0266875 A1 12/2005 Yegin et al.
2006/0062417 A1* 3/2006 Tachikawa ..... H04R 1/1066 381/370
2006/0256992 A1 11/2006 Liao
2007/0223766 A1 9/2007 Davis et al.
2008/0056525 A1 3/2008 Fujiwara et al.
2008/0175406 A1 7/2008 Smith
2009/0003616 A1 1/2009 Kleinschmidt et al.
2010/0177907 A1 7/2010 Morisawa
2012/0070027 A1 3/2012 Ridler
2012/0070028 A1 3/2012 Margulies
2012/0093334 A1 4/2012 Schreuder et al.
2012/0125360 A1 5/2012 Hill et al.
2012/0266909 A1 10/2012 Tsai
2014/0056459 A1 2/2014 Oishi et al.
2014/0105414 A1 4/2014 Rois et al.
2014/0153766 A1 6/2014 Huang
2014/0307868 A1 10/2014 Weis
2016/0079660 A1 3/2016 Bevelacqua
2016/0080853 A1 3/2016 Chen
2016/0205461 A1 7/2016 Fernandez-Medina et al.
2017/0041696 A1 2/2017 Levine et al.
2017/0041697 A1 2/2017 Levine et al.
2017/0113033 A1 4/2017 Wingeier et al.

(56) References Cited

U.S. PATENT DOCUMENTS

| | | | | |
|---|---|---|---|---|
| 2017/0134845 | A1 | 5/2017 | Milam et al. | |
| 2017/0201821 | A1 | 7/2017 | Mcauliffe et al. | |
| 2017/0257692 | A1 | 9/2017 | Yang et al. | |
| 2017/0265420 | A1 | 9/2017 | Carlson | |
| 2017/0295420 | A1 | 10/2017 | Yeung et al. | |
| 2017/0339479 | A1 | 11/2017 | Levine | |
| 2017/0353781 | A1 | 12/2017 | Choi et al. | |
| 2018/0020277 | A1 | 1/2018 | Briggs | |
| 2018/0020278 | A1 | 1/2018 | Levine et al. | |
| 2018/0227658 | A1 | 8/2018 | Hviid et al. | |
| 2021/0267300 | A1* | 9/2021 | Blomqvist ..... | H04R 1/08 |
| 2022/0406285 | A1 | 12/2022 | Neves et al. | |

FOREIGN PATENT DOCUMENTS

| | | | |
|---|---|---|---|
| CN | 306885647 | | 10/2021 |
| JP | 2013078014 | A | 4/2013 |
| JP | 2015026948 | | 2/2015 |
| KR | 1020170001125 | A | 1/2017 |

OTHER PUBLICATIONS

"International Search Report and Written Opinion Issued in PCT Application No. PCT/US2022/034823", dated Oct. 21, 2022, 9 Pages.

* cited by examiner

MULTI-MICROPHONE HEADSET

CROSS-REFERENCE TO RELATED APPLICATIONS

The present application is related by subject matter to U.S. Design patent application No. 29/796,516, filed concurrently herewith and entitled "Headset," which is specifically incorporated herein by reference for all that it discloses and teaches.

BACKGROUND

Audio equipment can provide sound output (e.g., via one or more speakers) and/or sound input (e.g., via one or more microphones). For example, a video gaming headset may include speakers positioned in earcups to provide sound output and a boom microphone (positioned at the end of a boom that extends from one of the earcups to a position near a user's mouth) to provide sound input. However, while the placement of a boom-mounted microphone (a "boom microphone") can provide excellent voice quality during operation, the boom can be awkward, "in the way," and unnecessary in many use cases (e.g., when the user is simply listening to music or does not require the quality provided by boom microphone.

SUMMARY

The foregoing problem is solved by an audio device including one or more earcups, at least one of the earcups including a boom connector port, a connection detector connected to the boom connector port and configured to detect a connection state at the boom connector port, one or more first microphones positioned in the one or more earcups, audio processing circuitry, and a microphone switch controller connected to the connection detector and configured to connect audio processing circuitry to one of the one or more first microphones or the boom connector port based on the detected connection state of the boom connector port.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

Other implementations are also described and recited herein.

BRIEF DESCRIPTIONS OF THE DRAWINGS

DETAILED DESCRIPTIONS

Figure 1:
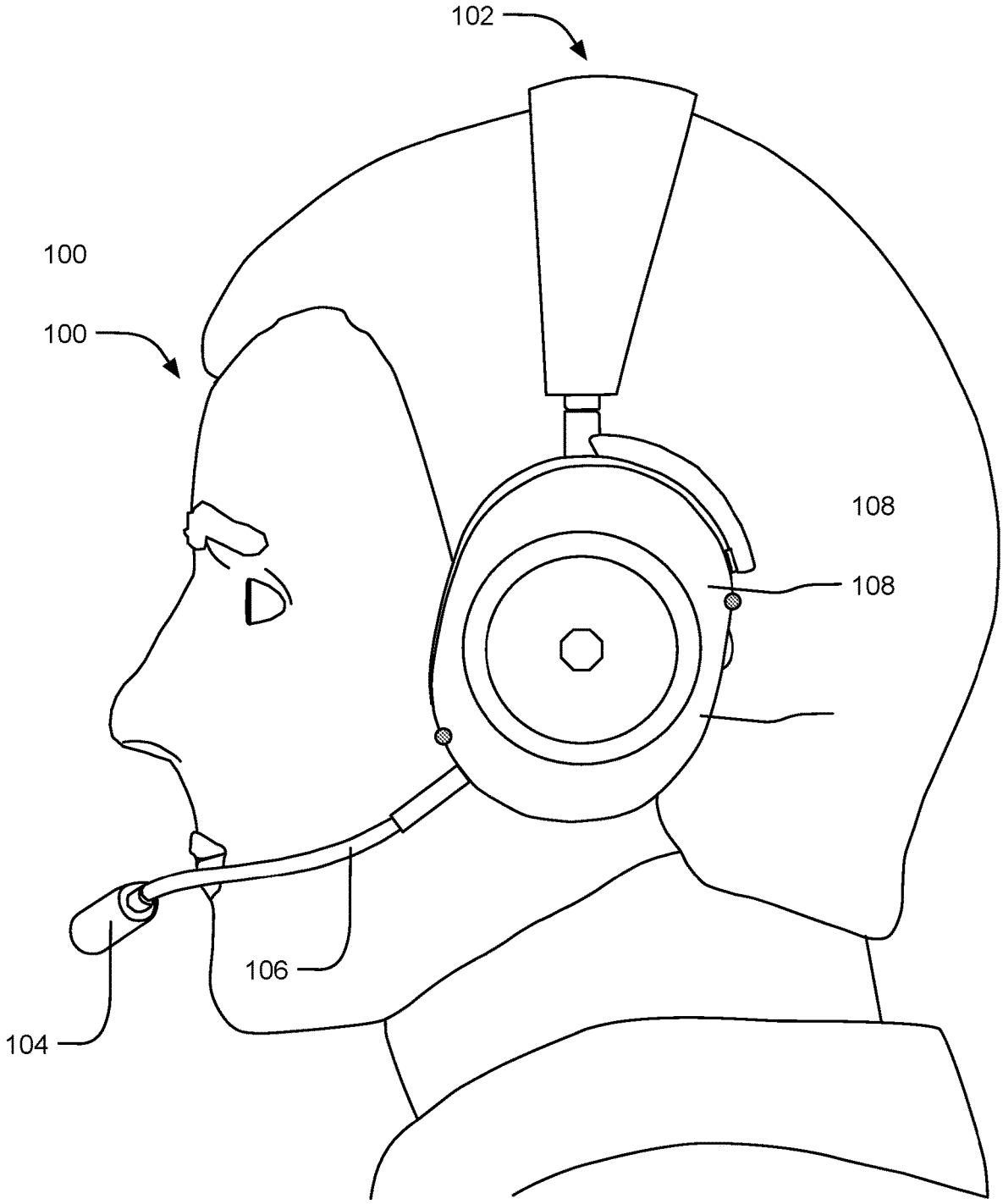
FIG. 1 illustrates a user wearing an example multi-microphone headset with a connected boom microphone.

FIG. 1 illustrates a user 100 wearing an example multi-microphone headset 102 with a connected boom microphone 104. In one implementation, the example multi-microphone headset 102 includes low-latency wireless gaming headphones that wirelessly connect to a gaming console or other wireless computing or communications device. Other implementations may include videoconferencing headphones and other headphones providing sound input and output capabilities.

The boom microphone 104 is electrically connected and attached by a boom 106 to a boom connector port (not shown) in an earcup 108 of the multi-microphone headset 102. The boom 106 provides structural support to position the boom microphone 104 in the proximity of the user's mouth and electrical connection to provide power and signal communications with circuitry in the earcup 108.

When the boom microphone 104 is electrically connected to the earcup 108, sound input is transferred to the multi-microphone headset 102 from the boom microphone 104. The boom 106 can be electrically disconnected and detached from the earcup 108, at which point circuitry in the earcup 108 detects the disconnection and/or the detachment and automatically switches sound input from the boom microphone 104 to beam-forming microphones (not shown) on the exterior of the earcup 108. It should be understood that automatic switching between microphones in response to detection of changes in a state of connection and/or attachment need not be limited to boom microphones and beam-forming microphones, as these are mere examples.

Figure 2:
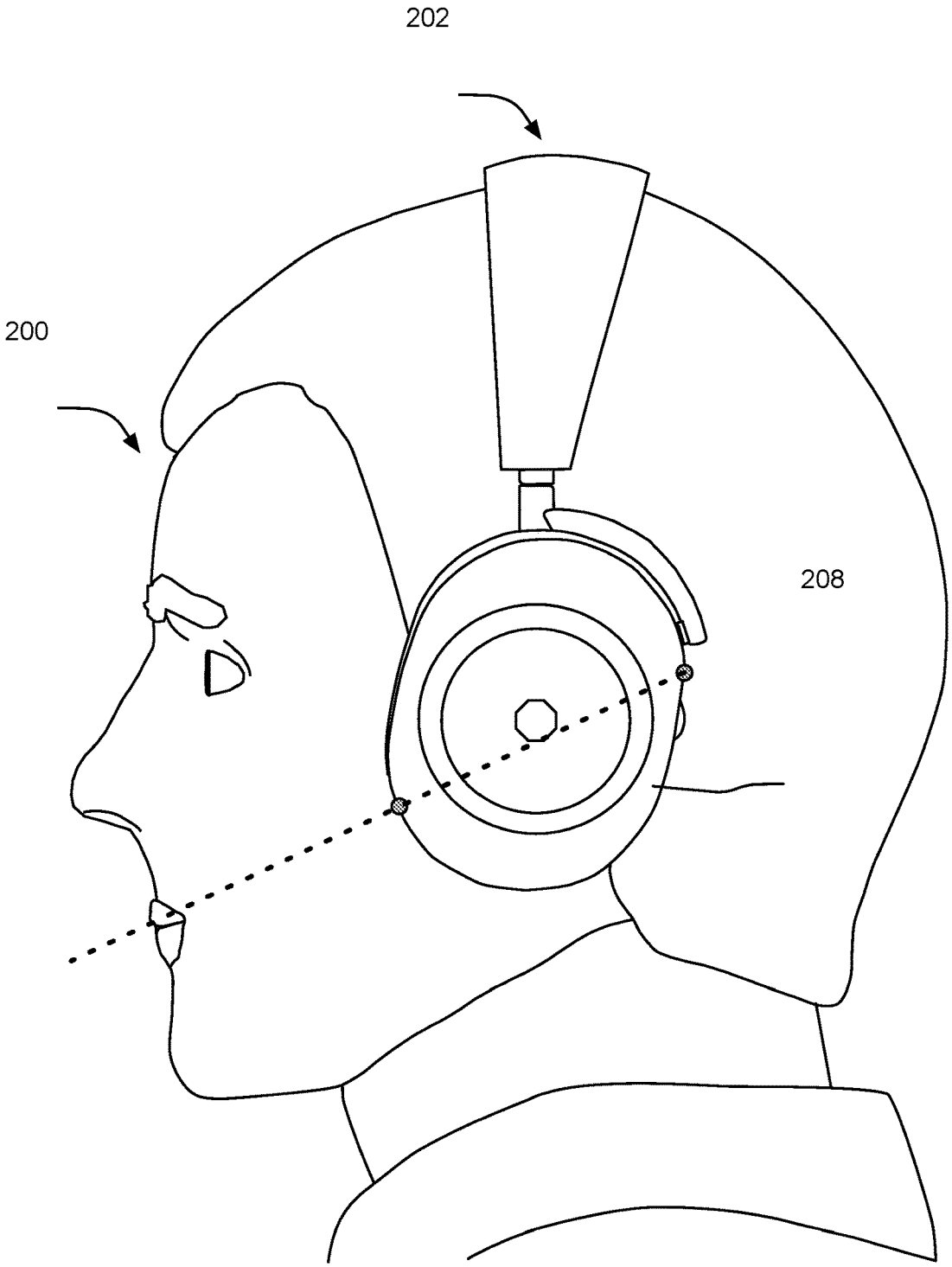
FIG. 2 illustrates a user wearing an example multi-microphone headset without a connected boom microphone.

FIG. 2 illustrates a user 200 wearing an example multi-microphone headset 202 without a connected boom microphone (not shown). The example multi-microphone headset 202 is similar to the example multi-microphone headset 102 of FIG. 1, but the boom microphone has been electrically disconnected and detached from an earcup 208. Accordingly, as discussed with respect to FIG. 1, the electrical disconnection and/or detachment of the boom microphone from the earcup 208 is detected by circuitry in the earcup 208, which automatically switches sound input from the boom microphone to beam forming microphones in the earcup 208 (not shown, but their positions are indicated by solid dots and the direction of the beam is shown by the dashed line 210, although another positioning may be employed). If the boom microphone is re-connected and attached to the earcup 208, the circuitry will detect it and automatically switch the sound input to the boom microphone.

Figure 3:
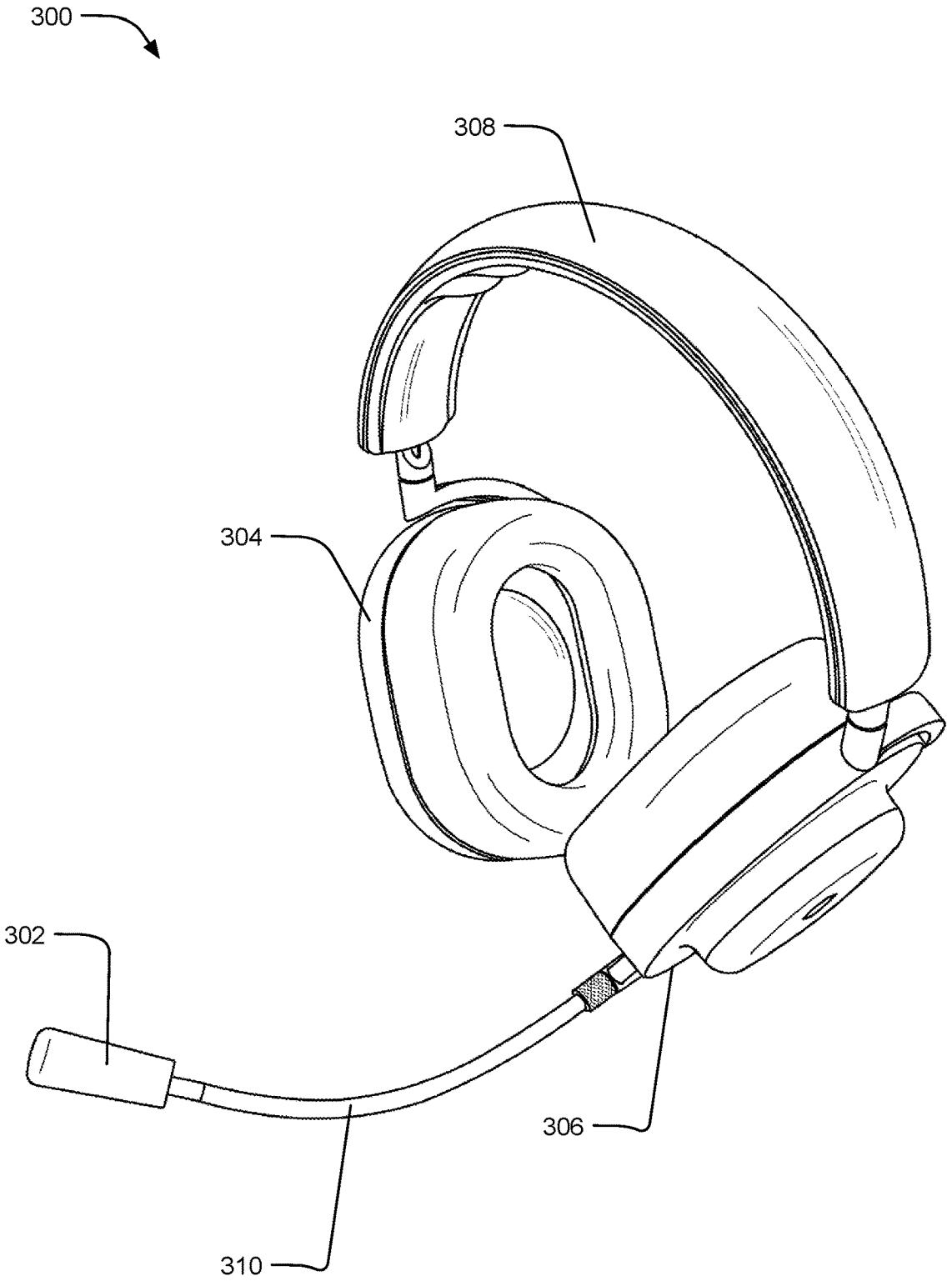
FIG. 3 illustrates a perspective view of an example multi-microphone headset with a connected boom microphone.

FIG. 3 illustrates a perspective view of an example multi-microphone headset 300 with a connected boom microphone 302. In one implementation, the example multi-microphone headset 300 are low-latency wireless gaming headphones that wirelessly connect to a gaming console or other wireless computing or communications device. Other implementations may include videoconferencing headphones and other headphones providing sound input and output capabilities.

Earcups 304 and 306 include speakers for sound output and are connected by an adjustable headband 308, which can electrically connect power and communication signals between the earcups 304 and 306. Accordingly, although circuitry for the automatic detection and switching of microphones is primarily described herein as being positioned within the earcup 306, the circuitry and ports for controlling and powering the multi-microphone headset 300 (including the detection and switching circuitry) can be distributed within one or both cups and/or the adjustable headband 308. One or both of the earcups 304 and 306 also include one or more microphones (not shown) as alternative sound inputs.

The boom microphone 302 is electrically connected and attached by a boom 310 to a boom connector port (not shown) in the earcup 306 of the multi-microphone headset 300. In one implementation, the boom 310 is connected to and attached to the boom connector port via a 2.5 mm jack, although other connections and/or attachments may be employed. The boom 310 provides structural support to position the boom microphone 302 in the proximity of the user's mouth and electrical connection to provide power and signal communications with the circuitry in the earcup 306. When the boom 310 is electrically connected and attached to the earcup 306, a connection detector in the circuitry detects the connection and/or attachment state, and a microphone switch controller configures the sound input to be received via the boom microphone 302. When the boom 310 is electrically disconnected and detached from the earcup 306, the connection detector in the circuitry detects the change in the connection and/or attachment state and the microphone switch controller in the circuitry configures the sound input to be received via the microphones in the earcup 306 or other microphones in the multi-microphone headset 300.

It should be understood that an example multi-microphone headset may have more than two microphones (e.g., more than one microphone in the boom and more than one microphone in the exterior of the earcup). Furthermore, an example multi-microphone headset may have additional microphones sets, such as one or more microphones positioned in the interior of the earcup to contribute to noise cancellation). Furthermore, in at least one implementation, the boom microphone 302 also includes a mute LED indicator (not shown) that is visible to the user when the user is wearing the multi-microphone headset 300 with the boom 310 connected.

Figure 4:
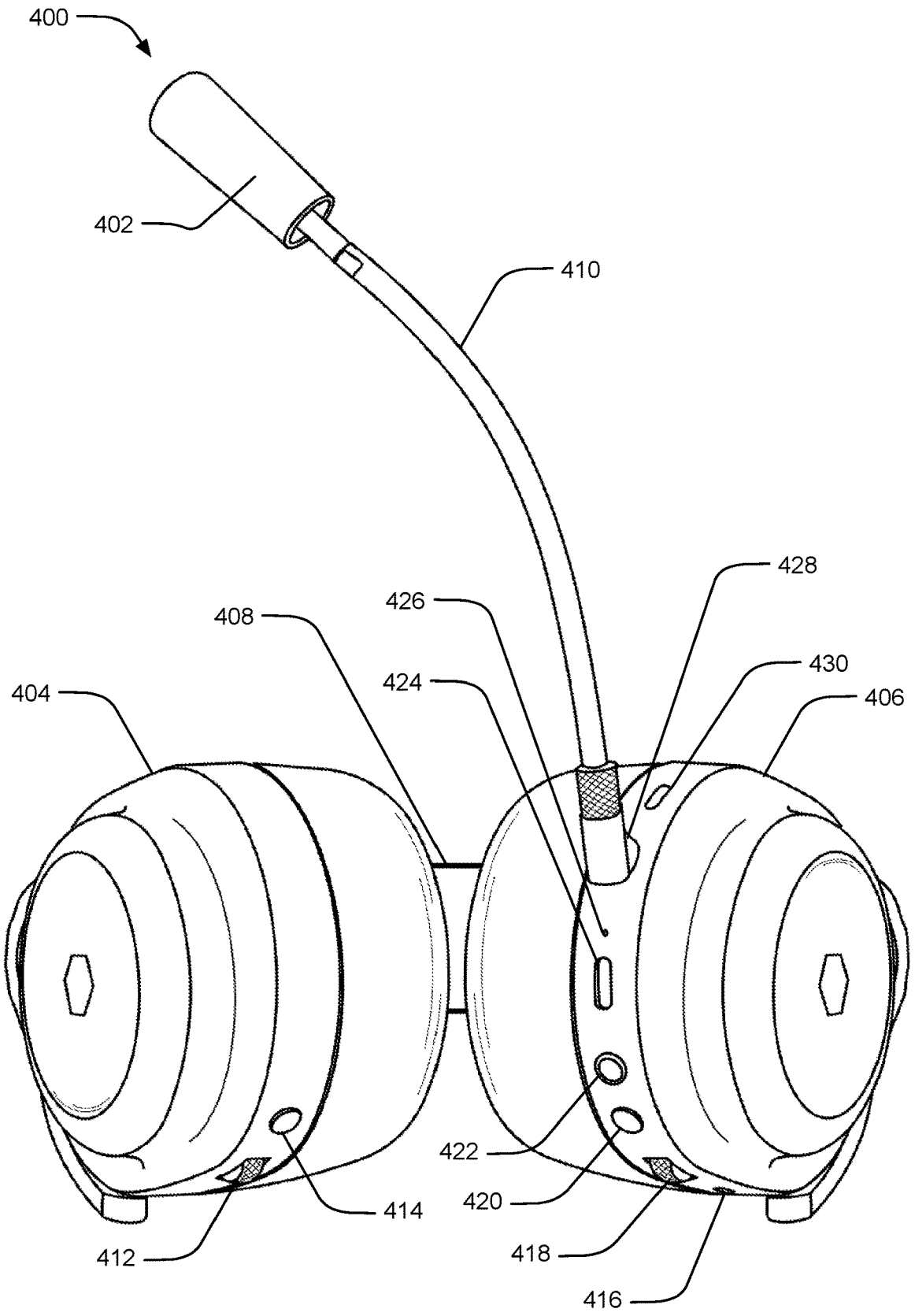
FIG. 4 illustrates a bottom view of an example multi-microphone headset with a connected boom microphone.

FIG. 4 illustrates a bottom view of an example multi-microphone headset 400 with a connected boom microphone 402. In one implementation, the example multi-microphone headset 400 are low-latency wireless gaming headphones that wirelessly connect to a gaming console or other wireless computing or communications device. Other implementations may include videoconferencing headphones and other headphones providing sound input and output capabilities.

Earcups 404 and 406 include speakers for sound output and are connected by an adjustable headband 408, which can electrically connect power and communication signals between the earcups 404 and 406. Accordingly, although circuitry for the automatic detection and switching of microphones is primarily described herein as being positioned within the earcup 406, the circuitry and ports for controlling and powering the multi-microphone headset 400 (including the detection and switching circuitry) can be distributed within one or both cups and/or the adjustable headband 408. One or both of the earcups 404 and 406 also include one or more microphones (not shown) as alternative sound inputs.

The boom microphone 402 is electrically connected and attached by a boom 410 to a boom connector port 428 in the earcup 406 of the multi-microphone headset 400. In one implementation, the boom 410 is connected to and attached to the boom connector port 428 via a 2.5 mm jack, although other connections and/or attachments may be employed. The boom 410 provides both structural support to position the boom microphone 402 in the proximity of the user's mouth and electrical connection, such as to provide power and signal communications with the circuitry in the earcup 406. When the boom 410 is electrically connected and attached to the earcup 406, a connection detector in the circuitry detects the connection and/or attachment state and a microphone switch controller configures the sound input to be received via the boom microphone 402. When the boom 410 is electrically disconnected and detached from the earcup 406, the connection detector in the circuitry detects the change in the connection and/or attachment state and the microphone switch controller in the circuitry configures the sound input to be received via the microphones in the earcup 406 or other microphones in the multi-microphone headset 400. Various controls and interfaces are positioned on the exterior of the earcups 404 and 406. In one implementation, a volume dial 412 and a multi-function button 414 are positioned on the exterior of the earcup 404, and the earcup 406 has the following items positioned on its exterior:

- a microphone 416
- a game chat volume 418 (with push-button mute)
- a 7.1 surround sound button 420
- a power button 422
- a USB-C port 424
- an LED indicator 426
- the boom connector port 428
- another microphone 430

In one implementation, the microphones 416 and 430 may be beam forming microphones. Additional microphones may be positioned within the interior of the earcups 404 and 406.

Figure 5:
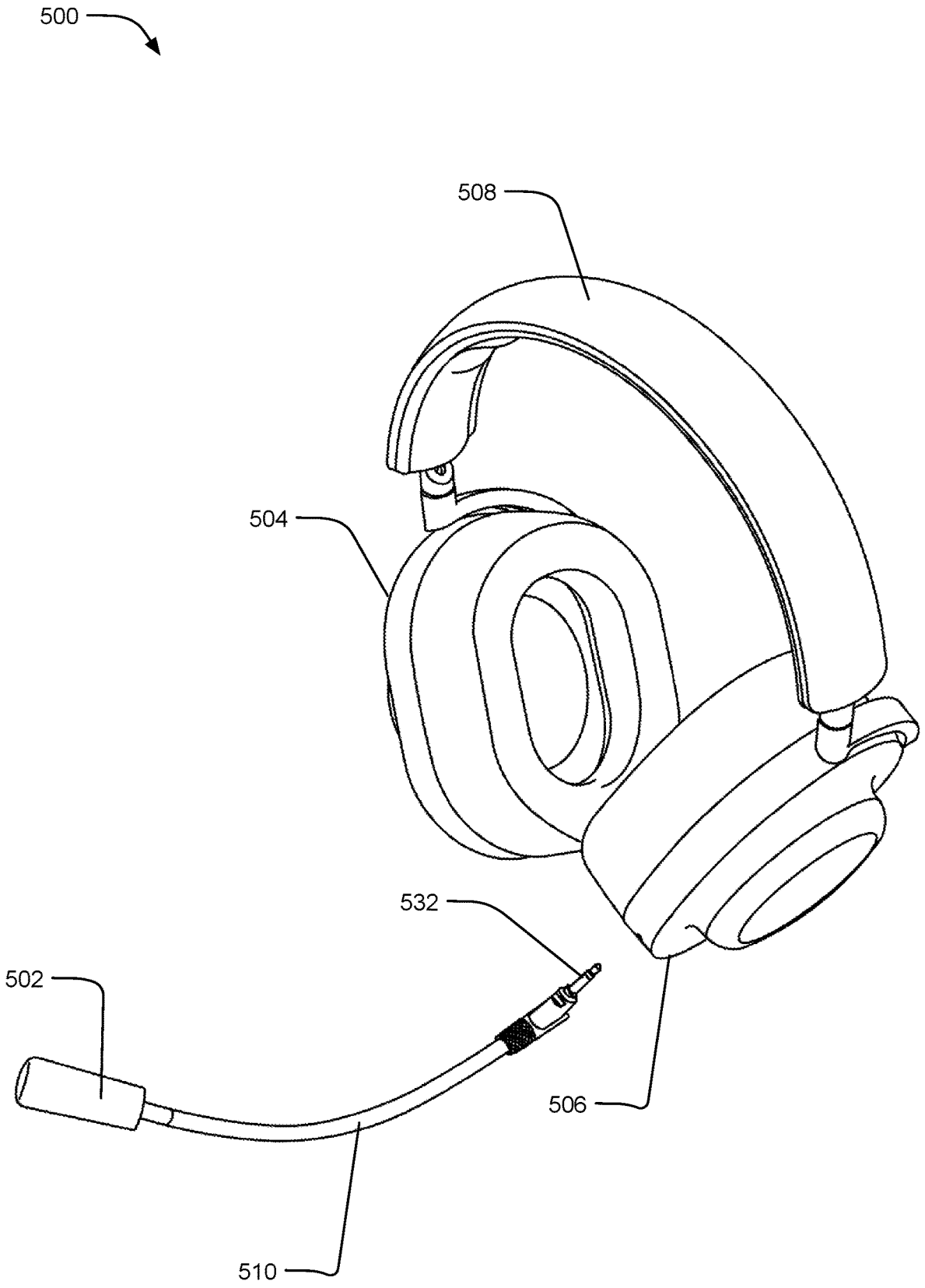
FIG. 5 illustrates a perspective view of an example multi-microphone headset without a connected boom microphone.

FIG. 5 illustrates a perspective view of an example multi-microphone headset 500 without a connected boom microphone 502. In one implementation, the example multi-microphone headset 500 are low-latency wireless gaming headphones that wirelessly connect to a gaming console or other wireless computing or communications device. Other implementations may include videoconferencing headphones and other headphones providing sound input and output capabilities.

Earcups 504 and 506 include speakers for sound output and are connected by an adjustable headband 508, which can electrically connect power and communication signals between the earcups 504 and 506. Accordingly, although circuitry for the automatic detection and switching of microphones is primarily described herein as being positioned within the earcup 506, the circuitry and ports for controlling and powering the multi-microphone headset 500 (including the detection and switching circuitry) can be distributed within one or both cups and/or the adjustable headband 508. One or both of the earcups 504 and 506 also include one or more microphones (not shown) as alternative sound inputs.

The boom microphone 502 is not electrically connected or attached by a boom 510 to a boom connector port (not shown) in the earcup 506 of the multi-microphone headset 500. In one implementation, the boom 510 includes a 2.5 mm jack 532, although other connections and/or attachments may be employed. However, in contrast to the boom 310 shown in FIG. 3, the boom 510 is shown in FIG. 5 as disconnected and unattached to the boom connector port, with the 2.5 mm jack 532 exposed. When connected, the boom 510 provides both structural support to position the boom microphone 502 in the proximity of the user's mouth and electrical connection, such as to provide power and signal communications with the circuitry in the earcup 506. Because the boom 510 is electrically disconnected and detached from the earcup 506, a connection detector in the circuitry detects the lack of connection and/or attachment, and a microphone switch controller configures the sound input to be received via the microphones in the earcup 506 or other microphones in the multi-microphone headset 500. If the user were to plug the 2.5 mm jack 532 into the boom connector port, the connection detector would detect the change in the connection/attachment state, and a microphone switch controller would switch sound input to the boom microphone 502.

It should be understood that an example multi-microphone headset may have more than two microphones (e.g., more than one microphone in the boom and more than one microphone in the exterior of the earcup). Furthermore, an example multi-microphone headset may have additional microphones sets, such as one or more microphones positioned in the interior of the earcup to contribute to noise cancellation).

Figure 6:
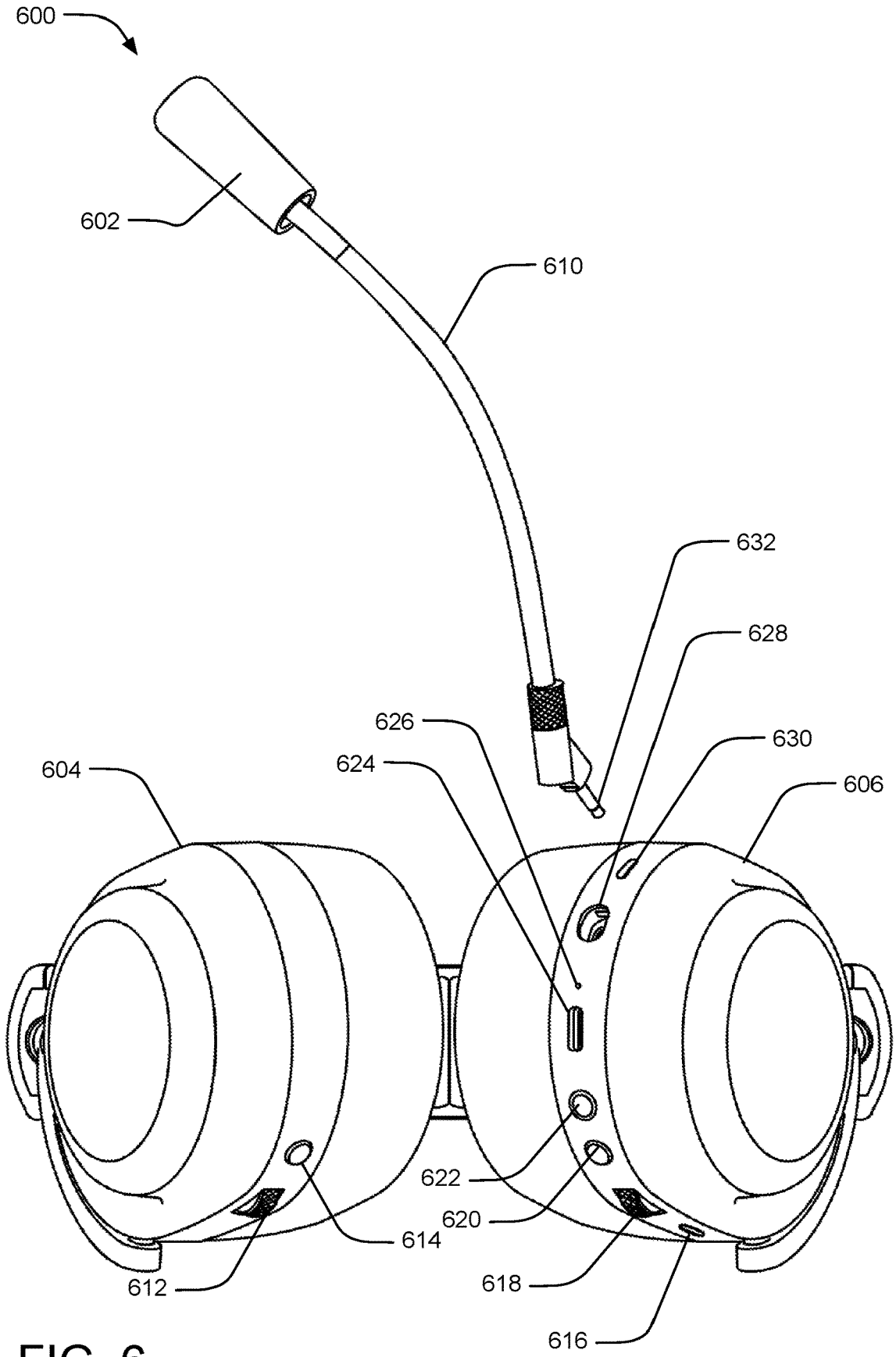
FIG. 6 illustrates a bottom view of an example multi-microphone headset without a connected boom microphone.

FIG. 6 illustrates a bottom view of an example multi-microphone headset 600 without a connected boom microphone. In one implementation, the example multi-microphone headset 600 are low-latency wireless gaming headphones that wirelessly connect to a gaming console or other wireless computing or communications device. Other implementations may include videoconferencing headphones and other headphones providing sound input and output capabilities.

Earcups 604 and 606 include speakers for sound output and are connected by an adjustable headband 608, which can electrically connect power and communication signals between the earcups 604 and 606. Accordingly, although circuitry for the automatic detection and switching of microphones is primarily described herein as being positioned within the earcup 606, the circuitry and ports for controlling and powering the multi-microphone headset 600 (including the detection and switching circuitry) can be distributed within one or both cups and/or the adjustable headband 608. One or both of the earcups 604 and 606 also include one or more microphones (not shown) as alternative sound inputs.

The boom microphone 602 is electrically connected and attached by a boom 610 to a boom connector port 628 in the earcup 606 of the multi-microphone headset 600. In one implementation, the boom 610 is connected to and attached to the boom connector port 628 via a 2.5 mm jack, although other connections and/or attachments may be employed. However, in contrast to the boom 410 shown in FIG. 4, the boom 610 is shown in FIG. 6 as disconnected and unattached to the boom connector port 628, with the 2.5 mm jack 632 exposed. When connected, the boom 610 provides both structural support to position the boom microphone 602 in the proximity of the user's mouth and electrical connection, such as to provide power and signal communications with the circuitry in the earcup 606. Because the boom 610 is electrically disconnected and detached from the earcup 606, a connection detector in the circuitry detects the lack of connection and/or attachment, and a microphone switch controller configures the sound input to be received via the microphones in the earcup 606 or other microphones in the multi-microphone headset 600. If the user were to plug the 2.5 mm jack 632 into the boom connector port, the connection detector would detect the change in the connection/attachment state, and a microphone switch controller would switch sound input to the boom microphone 602.

Various controls and interfaces are positioned on the exterior of the earcups 604 and 606. In one implementation, a volume dial 612 and a multi-function button 614 are positioned on the exterior of the earcup 604, and the earcup 606 has the following items positioned on its exterior:

a microphone 616
a game chat volume 618 (with push-button mute)
a 7.1 surround sound button 620
a power button 622
a USB-C port 624
an LED indicator 626
the boom connector port 628 (e.g., a 2.5 mm jack)
another microphone 630

In one implementation, the microphones 616 and 630 may be beam forming microphones. Additional microphones may be positioned within the interior of the earcups 604 and 606.

Figure 7:
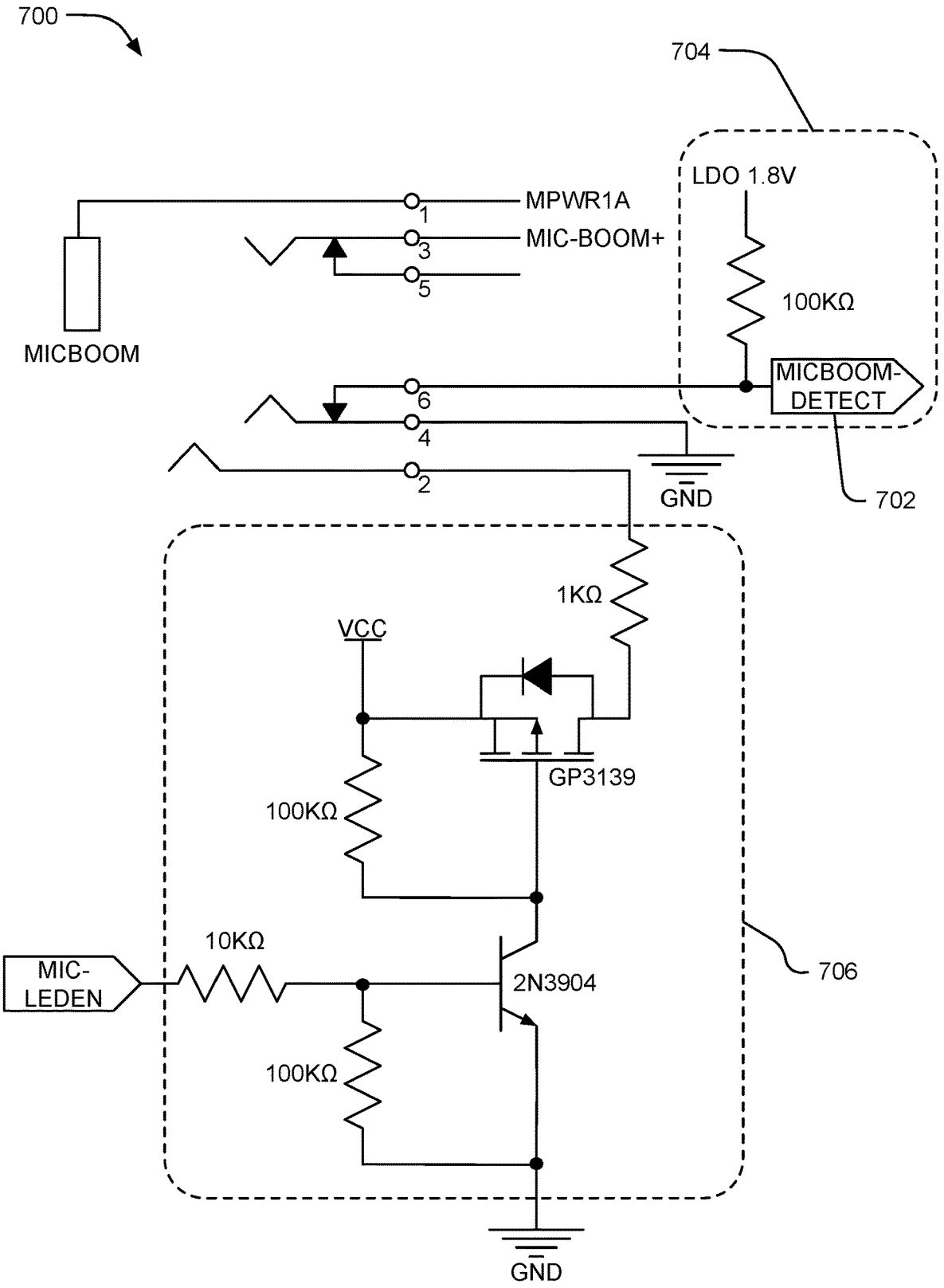
FIG. 7 illustrates an electrical schematic of an example microphone switching circuit.

FIG. 7 illustrates an electrical schematic of an example connection detector and microphone switching circuit 700. The MICBOOM-DET signal 702 in the connection detector 704 is at a low logic signal (e.g., low voltage) when the boom plug is not inserted into the boom connector port. When the boom plug is inserted into the boom connector port, then the connection between pin 6 and pin 4 of the 2.5 mm jack is opened, and the MICBOOM-DET signal 702 is pulled high to indicate the change in the connection state. The connection/attachment state can be saved as a parameter in the audio processing circuitry or microphone switch controller to effect the appropriate connection for sound input.

An example electrical detection mechanism is described with regard to FIG. 7. Alternatively, other detection mechanisms may be used, including without limitation a mechanical or magnetic switch that is triggered when the plug is inserted into the connector port. A change in connection state can be detected by such switches, and a signal or parameter is changed accordingly to switch between two sets of microphones in the headphones (e.g., boom microphone(s) or earcup microphone(s)).

Figure 8:
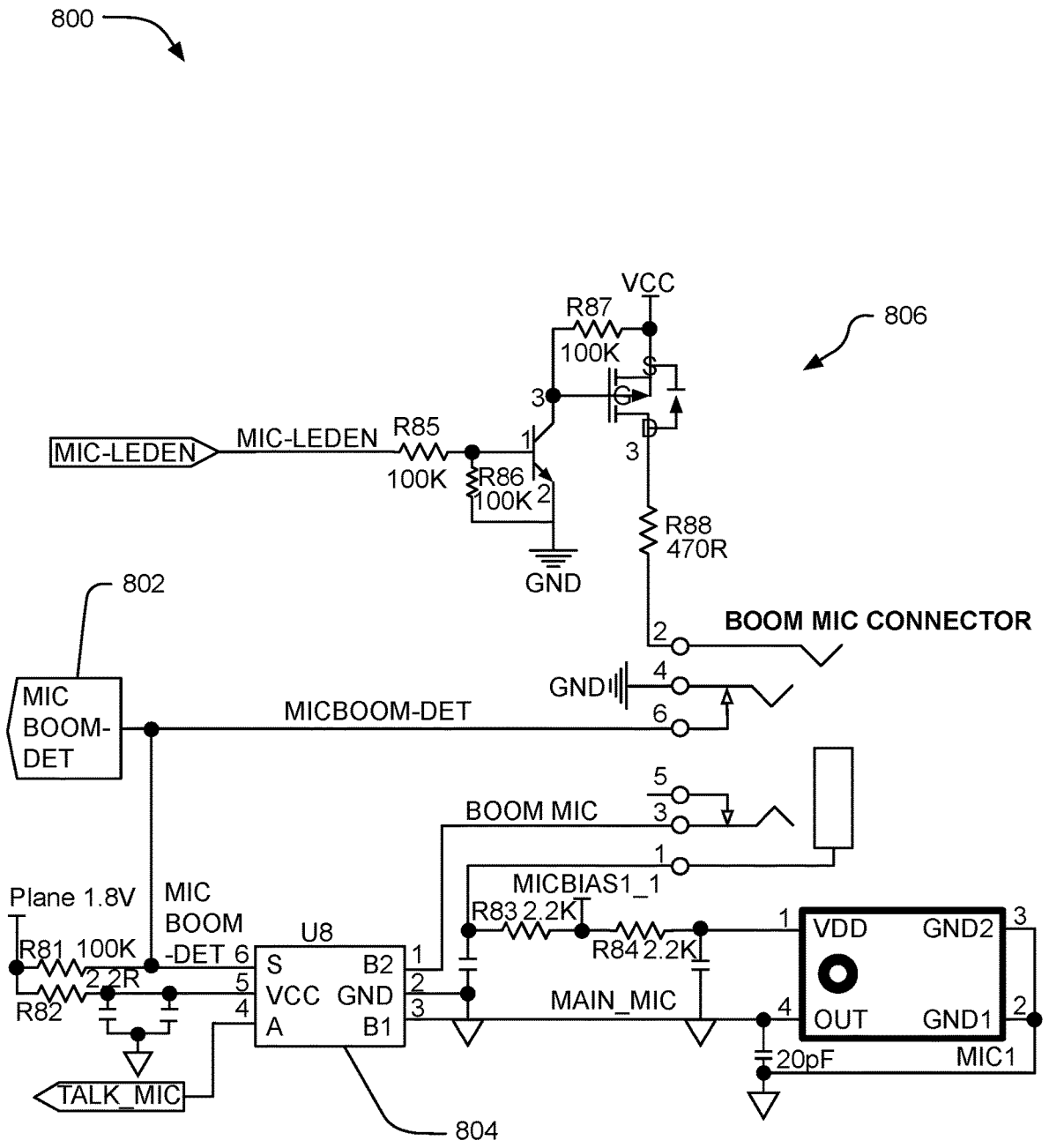
FIG. 8 illustrates an alternative electrical schematic of an example microphone switching circuit.

FIG. 8 illustrates an alternative electrical schematic of an example microphone switching circuit 800. In a manner similar to that of FIG. 7, the circuitry enables the appropriate microphone (e.g., the ear cup microphone, the boom microphone) based on the connection state of the boom. Depending on the connection state "MICBOOM-DET" signal, a microphone switch controller U8 (block 804) connects the sound input from either the earcup microphone ("MAIN_MIC") or the boom microphone ("BOOM_MIC") to the audio processing circuitry. A connection state (e.g., the "MICBOOM-DET" signal 802) may also be used to inform the audio processor which microphone is used as the active microphone (via signal "TALK_MIC") and configure the audio processing algorithm for electronic noise cancellation to match the selected microphones, which can often have different audio capabilities and characteristics. The "MIC-LEDEN" signal is used to control the LED on/off on the boom mic for mute state indication, as controlled by circuitry 806.

An example electrical detection mechanism is described with regard to FIG. 8. Alternatively, other detection mechanisms may be used, including without limitation a mechanical or magnetic switch that is triggered when the plug is inserted into the connector port. A change in connection state can be detected by such switches, and a signal or parameter is changed accordingly to switch between two sets of microphones in the headphones (e.g., boom microphone(s) or earcup microphone(s)).

Figure 9:
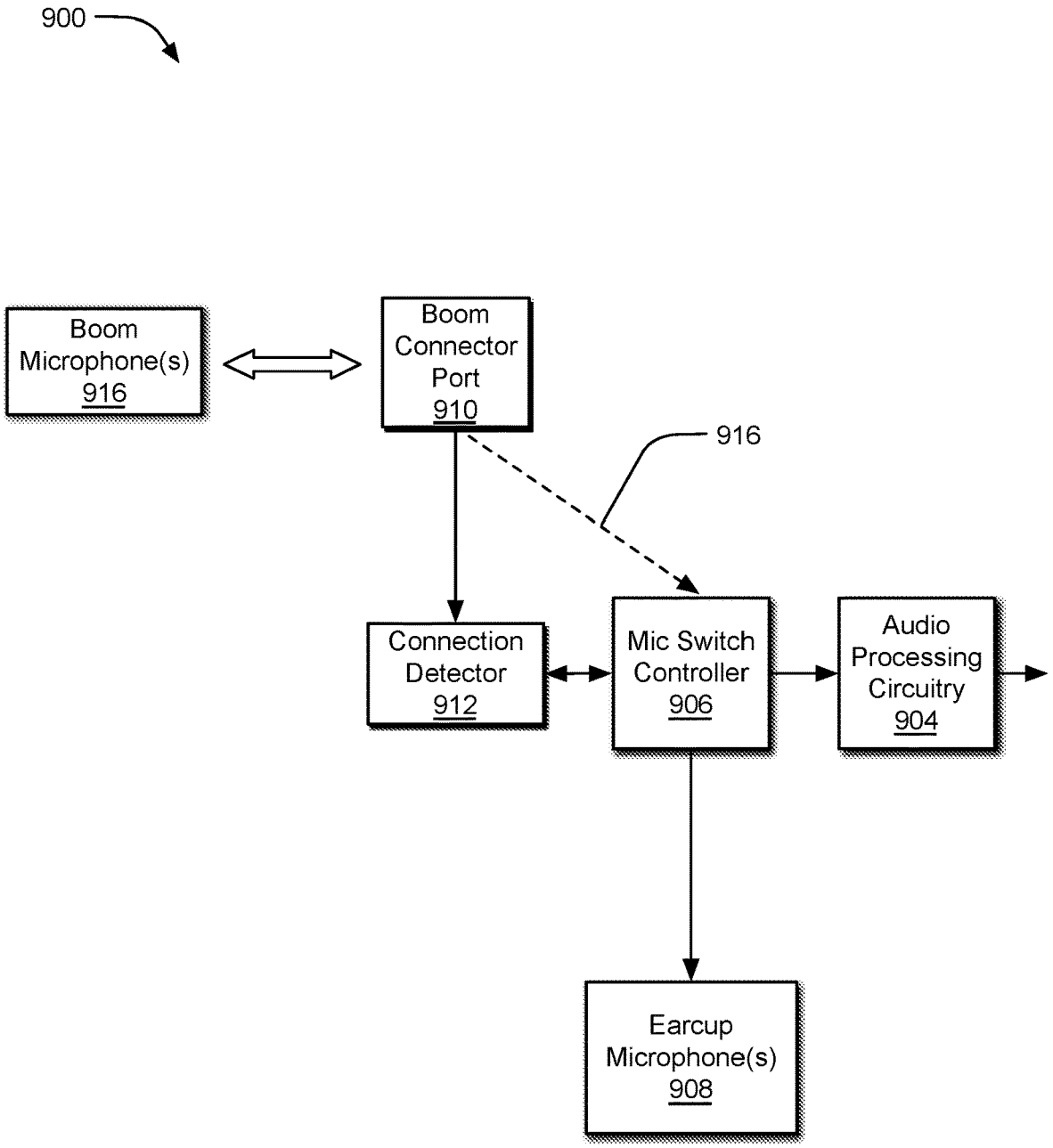
FIG. 9 illustrates a block diagram of an example microphone switching circuit.

FIG. 9 illustrates a block diagram of an example connection detector and microphone switching circuit 900. Audio processing circuitry 904 is configured to receive sound input from a microphone switch controller 906 and to provide audio processing functionality, such as noise cancellation, filtering, muting, communication to a wireless transceiver and/or other circuitry, etc. The microphone switch controller 906 is coupled to one or more earcup microphones 908 and a boom connector port 910 (through a connection detector 912 or via an alternative connection 914). The boom connector port 910 is configured to receive a boom connector plug (not shown) connected to one or more boom microphones 916. The boom connector plug can be removably connected/attached to the boom connector port 910 by a user.

The connection detector 912 can detect whether the one or more boom microphones 916 are connected to the boom connector port 910. For example, in one implementation, connection of a boom plug to the boom connector port 910 can open an electrical connection in the boom connector port 910 to raise a voltage level on the MICBOOM-DETECT signal, which indicates a state of a connected/attached boom microphone. A low voltage on the MICBOOM-DETECT signal indicates a state of a disconnected/unattached boom microphone. Other boom detection schemes may be employed.

When the connection detector 912 detects that the one or more boom microphones 916 are connected to the boom connector port 910, the microphone switch controller 906 directs sound input to the audio processing circuitry 904 from the boom connector port 910, rather than from the one or more earcup microphones 908. In contrast, when the connection detector 912 detects that the one or more boom microphones 916 are not connected to the boom connector port 910, the microphone switch controller 906 directs sound input to the audio processing circuitry 904 from the one or more earcup microphones 908, rather than from the boom connector port 910.

Figure 10:
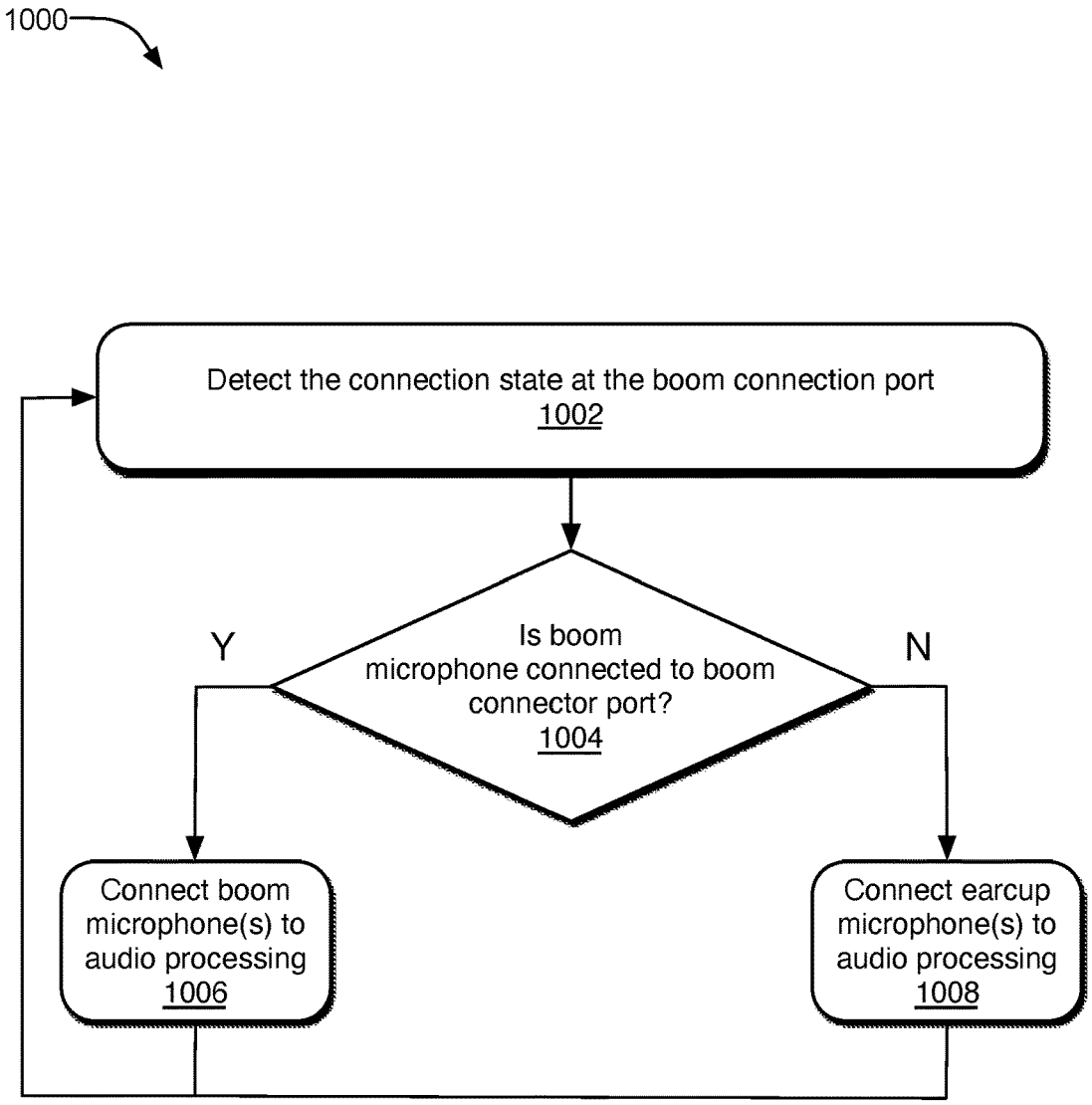
FIG. 10 illustrates a flow diagram of example operations for switching microphones in a multi-microphone headset.

FIG. 10 illustrates a flow diagram of example operations 1000 for switching microphones in a multi-microphone headset. A detection operation 1002 detects the connection state at the boom connection port. A decision operation 1004 determines whether the boom microphone (and/or the boom) are connected at the boom connection port. If so, a connection operation 1006 connects sound input from the boom microphone to the audio processing circuitry. If not, a connection operation 1008 connects sound input from the earcup microphones to the audio processing circuitry. Processing returns to the detection operation 1002.

An example audio device includes audio processing circuitry and one or more earcups, at least one of the earcups including a boom connector port. A connection detector connects to the boom connector port and is configured to detect a connection state at the boom connector port. One or more first microphones are positioned in the one or more earcups. A microphone switch controller is connected to the connection detector and is configured to connect the audio processing circuitry to one of the one or more first microphones or the boom connector port based on the detected connection state of the boom connector port.

Another example audio device of any preceding audio device further includes one or more second microphones supported by a boom having a boom connector jack that is compatible for electrical connection and removable attachment to the boom connector port. The microphone switch controller is configured to connect the one or more second microphones to the audio processing circuitry responsive to detection that the boom is attached to the boom connector port.

Another example audio device of any preceding audio device is provided, wherein one or more audio processing parameters of the audio processing circuitry are adjusted to the one or more first microphones or the one or more second microphones based on the detected connection state of the boom connector port.

Another example audio device of any preceding audio device is provided, wherein the microphone switch controller is configured to connect the one or more first microphones to the audio processing circuitry responsive to detection that a boom is not attached to the boom connector port.

Another example audio device of any preceding audio device is provided, wherein the detected connection state of the boom connector port is recorded as a connection parameter in the audio device by the connection detector.

Another example audio device of any preceding audio device is provided, wherein the detected connection state of the boom connector port is recorded as a connection parameter in the audio device that is readable by the microphone switch controller.

Another example audio device of any preceding audio device is provided, wherein the connection detector mechanically detects the connection state at the boom connector port.

Another example audio device of any preceding audio device is provided, wherein the connection detector electrically detects the connection state at the boom connector port.

Another example audio device of any preceding audio device is provided, wherein the connection detector magnetically detects the connection state at the boom connector port.

An example method includes detecting a connection state at a boom connector port of one or more earcups of an audio device, the one or more earcups including one or more first microphones and connecting audio processing circuitry of the audio devices to one of the one or more first microphones and the boom connector port based on the detected connection state of the boom connector port.

Another example method of any preceding method further includes providing one or more second microphones supported by a boom having a boom connector jack that is compatible for electrical connection and removable attachment to the boom connector port and connecting the one or more second microphones to the audio processing circuitry responsive to detection that the boom is attached to the boom connector port.

Another example method of any preceding method further includes adjusting one or more audio processing parameters of the audio processing circuitry to the one or more first microphones or the one or more second microphones based on the detected connection state of the boom connector port.

Another example method of any preceding method is provided, wherein the connecting operation includes connecting the one or more first microphones to the audio processing circuitry responsive to detection that a boom is not attached to the boom connector port.

Another example method of any preceding method is provided, wherein the detected connection state of the boom connector port is recorded as a connection parameter in the audio device.

Another example method of any preceding method is provided, wherein the connection detector mechanically detects the connection state at the boom connector port.

Another example method of any preceding method is provided, wherein the connection detector electrically detects the connection state at the boom connector port.

Another example method of any preceding method is provided, wherein the connection detector magnetically detects the connection state at the boom connector port.

Example wireless headphones include audio processing circuitry and one or more earcups, at least one of the earcups including a boom connector port. A connection detector is connected to the boom connector port and is configured to detect a connection state at the boom connector port. One or more first microphones are positioned in the one or more earcups. A microphone switch controller is connected to the connection detector and is configured to connect the audio processing circuitry to one of the one or more first microphones or the boom connector port based on the detected connection state of the boom connector port.

Other example wireless headphones of any previous headphones further include one or more second microphones supported by a boom having a boom connector jack that is compatible for electrical connection and removable attachment to the boom connector port, wherein the microphone switch controller is configured to connect the one or more second microphones to the audio processing circuitry responsive to detection that the boom is attached to the boom connector port.

Other example wireless headphones of any previous headphones are provided, wherein the microphone switch controller is configured to connect the one or more first microphones to the audio processing circuitry responsive to detection that a boom is not attached to the boom connector port.

While this specification contains many specific implementation details, these should not be construed as limitations on the scope of any inventions or of what may be claimed, but rather as descriptions of features specific to particular embodiments of a particular described technology. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can, in some cases, be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments, and it should be understood that the described program components and systems can generally be integrated together in a single software/firmware product or packaged into multiple software/firmware products.

What is claimed is:

1. An audio device comprising:

one or more earcups, at least one of the earcups including a boom connector port;

a connection detector connected to the boom connector port and configured to detect a connection state at the boom connector port;

one or more first microphones positioned in the one or more earcups;

audio processing circuitry;

a microphone switch controller connected to the connection detector and configured to connect the audio processing circuitry to one of the one or more first microphones or the boom connector port based on the detected connection state of the boom connector port; and one or more second microphones supported by a boom having a boom connector jack that is compatible for electrical connection and removable attachment to the boom connector port, wherein the microphone switch controller is further configured to connect the one or more second microphones to the audio processing circuitry responsive to detection that the boom is attached to the boom connector port.

2. The audio device of claim 1, wherein one or more audio processing parameters of the audio processing circuitry are adjusted to the one or more first microphones or the one or more second microphones based on the detected connection state of the boom connector port.

3. The audio device of claim 1, wherein the microphone switch controller is configured to connect the one or more first microphones to the audio processing circuitry responsive to detection that a boom is not attached to the boom connector port.

4. The audio device of claim 1, wherein the detected connection state of the boom connector port is recorded as a connection parameter in the audio device by the connection detector.

5. The audio device of claim 1, wherein the detected connection state of the boom connector port is recorded as a connection parameter in the audio device that is readable by the microphone switch controller.

6. The audio device of claim 1, wherein the connection detector mechanically detects the connection state at the boom connector port.

7. The audio device of claim 1, wherein the connection detector electrically detects the connection state at the boom connector port.

8. The audio device of claim 1, wherein the connection detector magnetically detects the connection state at the boom connector port.

9. A method comprising:

detecting a connection state at a boom connector port of one or more earcups of an audio device, the one or more earcups including one or more first microphones;

connecting audio processing circuitry of the audio devices to one of the one or more first microphones and the boom connector port based on the detected connection state of the boom connector port;

providing one or more second microphones supported by a boom having a boom connector jack that is compatible for electrical connection and removable attachment to the boom connector port; and connecting the one or more second microphones to the audio processing circuitry responsive to detection that the boom is attached to the boom connector port.

10. The method of claim 9, further comprising:

adjusting one or more audio processing parameters of the audio processing circuitry to the one or more first microphones or the one or more second microphones based on the detected connection state of the boom connector port.

11. The method of claim 9, wherein the connecting operation comprises:

connecting the one or more first microphones to the audio processing circuitry responsive to detection that a boom is not attached to the boom connector port.

12. The method of claim 9, wherein the detected connection state of the boom connector port is recorded as a connection parameter in the audio device.

13. The method of claim 9, wherein the connection detector mechanically detects the connection state at the boom connector port.

14. The method of claim 9, wherein the connection detector electrically detects the connection state at the boom connector port.

15. The method of claim 9, wherein the connection detector magnetically detects the connection state at the boom connector port.

16. Wireless headphones comprising:

one or more earcups, at least one of the earcups including a boom connector port;

a connection detector connected to the boom connector port and configured to detect a connection state at the boom connector port;

one or more first microphones positioned in the one or more earcups;

audio processing circuitry;

a microphone switch controller connected to the connection detector and configured to connect the audio processing circuitry to one of the one or more first microphones or the boom connector port based on the detected connection state of the boom connector port; and one or more second microphones supported by a boom having a boom connector jack that is compatible for electrical connection and removable attachment to the boom connector port, wherein the microphone switch controller is configured to connect the one or more second microphones to the audio processing circuitry responsive to detection that the boom is attached to the boom connector port.

17. The wireless headphones of claim 16, wherein the microphone switch controller is configured to connect the one or more first microphones to the audio processing circuitry responsive to detection that a boom is not attached to the boom connector port.

18. An audio device comprising:

one or more earcups, at least one of the earcups including a boom connector port;

a connection detector connected to the boom connector port and configured to detect a connection state at the boom connector port;

one or more first microphones positioned in the one or more earcups;

audio processing circuitry; and a microphone switch controller connected to the connection detector and configured to connect the audio processing circuitry to one of the one or more first microphones or the boom connector port based on the detected connection state of the boom connector port;

wherein the microphone switch controller is further configured to connect the one or more first microphones to the audio processing circuitry responsive to detection that a boom is not attached to the boom connector port.

19. An audio device comprising:

one or more earcups, at least one of the earcups including a boom connector port;

a connection detector connected to the boom connector port and configured to detect a connection state at the boom connector port;

one or more first microphones positioned in the one or more earcups;

audio processing circuitry; and a microphone switch controller connected to the connection detector and configured to connect the audio processing circuitry to one of the one or more first microphones or the boom connector port based on the detected connection state of the boom connector port; and wherein the detected connection state of the boom connector port is recorded as a connection parameter in the audio device by the connection detector.

20. An audio device comprising:

one or more earcups, at least one of the earcups including a boom connector port;

a connection detector connected to the boom connector port and configured to detect a connection state at the boom connector port;

one or more first microphones positioned in the one or more earcups;

audio processing circuitry; and a microphone switch controller connected to the connection detector and configured to connect the audio processing circuitry to one of the one or more first microphones or the boom connector port based on the detected connection state of the boom connector port;

wherein the detected connection state of the boom connector port is recorded as a connection parameter in the audio device that is readable by the microphone switch controller.

21. A method comprising:

detecting a connection state at a boom connector port of one or more earcups of an audio device, the one or more earcups including one or more first microphones; and connecting audio processing circuitry of the audio devices to one of the one or more first microphones and the boom connector port based on the detected connection state of the boom connector port;

wherein the connecting operation comprises:

connecting the one or more first microphones to the audio processing circuitry responsive to detection that a boom is not attached to the boom connector port.

22. A method comprising:

detecting a connection state at a boom connector port of one or more earcups of an audio device, the one or more earcups including one or more first microphones; and connecting audio processing circuitry of the audio devices to one of the one or more first microphones and the boom connector port based on the detected connection state of the boom connector port;

wherein the detected connection state of the boom connector port is recorded as a connection parameter in the audio device.

23. Wireless headphones comprising:

one or more earcups, at least one of the earcups including a boom connector port;

a connection detector connected to the boom connector port and configured to detect a connection state at the boom connector port;

one or more first microphones positioned in the one or more earcups;

audio processing circuitry; and a microphone switch controller connected to the connection detector and configured to connect the audio processing circuitry to one of the one or more first microphones or the boom connector port based on the detected connection state of the boom connector port;

wherein the microphone switch controller is configured to connect the one or more first microphones to the audio processing circuitry responsive to detection that a boom is not attached to the boom connector port.

* * * * *